United States Patent [19]

Leluan, Jr.

[11] Patent Number: 4,957,263

[45] Date of Patent: Sep. 18, 1990

[54] UNIVERSAL CUP AND SAUCER DISPLAY

[76] Inventor: Sidney J. Leluan, Jr., 3130 E. Seneca, Tucson, Ariz. 85716

[21] Appl. No.: 274,360

[22] Filed: Nov. 21, 1988

[51] Int. Cl.[5] ..... A47B 97/04

[52] U.S. Cl. ..... 248/473; 248/176

[58] Field of Search ..... 248/457, 469, 470, 472, 248/473, 116, 146, 152, 163.1, 174, 176, 488, 490

[56] References Cited

U.S. PATENT DOCUMENTS

| | | | |
|---|---|---|---|
| 525,186 | 8/1894 | Bowley . | |
| 1,203,659 | 11/1916 | Smith . | |
| 1,208,622 | 12/1916 | Muller . | |
| 1,363,138 | 12/1920 | Markham . | |
| 1,875,288 | 8/1932 | Welk . | |
| 1,902,011 | 3/1933 | Brewer . | |
| 2,022,865 | 12/1935 | McAdams . | |
| 2,419,721 | 4/1947 | Kopp . | |
| 2,422,261 | 6/1947 | Richards | 248/473 |
| 2,441,655 | 5/1948 | Anderson . | |
| 2,563,671 | 8/1951 | Basinger . | |
| 2,592,252 | 4/1952 | DeCoste . | |
| 3,282,437 | 11/1966 | Hansen . | |
| 3,562,796 | 2/1971 | Jacobson . | |
| 3,999,734 | 12/1976 | Gibson . | |
| 4,113,212 | 9/1978 | Coriden . | |
| 4,162,013 | 7/1979 | Tucker . | |
| 4,343,450 | 8/1982 | Anderson . | |
| 4,364,537 | 12/1982 | Helzer | 248/488 |
| 4,483,505 | 11/1984 | Dalbo . | |
| 4,508,307 | 4/1985 | Morales . | |

FOREIGN PATENT DOCUMENTS

| | | | |
|---|---|---|---|
| 1390426 | 1/1965 | France | 248/460 |
| 629591 | 12/1961 | Italy | 248/163.1 |
| 80992 | 11/1952 | Norway | 248/490 |
| 393866 | 6/1933 | United Kingdom . | |

OTHER PUBLICATIONS

The Pierce Company Catalog, "Modern Line", Nov. 1946, pp. 1–4.

*Primary Examiner*—Ramon O. Ramirez
*Assistant Examiner*—Robert A. Olson
*Attorney, Agent, or Firm*—J. Michael McClanahan

[57] ABSTRACT

A universal cup and saucer display is detailed and described having a pair of spaced apart, parallel elongated legs, attached by a plurality of cross members, the legs having decorative designs at each end. The bottom portion of the decorative designs provide feet for the base to rest upon a surface and the upper portion of the front design provide a concave catch to receive the circular rim of a basket or plate singularly displayed. An upper rounded rear portion of the leg rear designs secure a pivotal pin passing through a back rest consisting of a flat plate with wings attached along three of four sides, two of the wings being utilized to receive the pivotal pin. The back is adjustable to varying angles. Lastly, a removable cup insert plate is situated between the two legs proximate the front portion of the base, the cup insert plate having a centrally located opening to receive the side walls of a cup. The universal cup and saucer display may be utilized to prominently display a cup, saucer, or cup and saucer, upon a horizontal surface or, by means of an opening in the flat back rest, by suspending the display upon a nail protruding from a wall.

12 Claims, 1 Drawing Sheet

UNIVERSAL CUP AND SAUCER DISPLAY

BACKGROUND OF THE INVENTION

1. Field of the Invention

The field of the invention is devices which display for viewing decorative cups and saucers, or plates or baskets singularly wherein the article or articles to be displayed are placed in a prominent viewing position.

2. Description of Related Art.

Devices to prominently display a plate or photograph, plaque, and the like have been known for a number of years and range in construction from rubber covered wire frames designed primarily to hold a plate nearly vertical to more complicated devices, such as those that consist of a base with a lateral position adjusting upright back rest whereby the circular rim of a plate is positioned at the front end of the base and supported nearly vertically by a back rest. For example, Gibson illustrates in U.S. Pat. No. 3,999,734, a adjustable display holder having a horizontal base having two parallel legs and a back rest protruding upward at an angle slightly off vertical, the back rest adapted to be placed in one of four different lateral positions relative to the front portion of the base.

Anderson, in later Pat. No. 4,343,450, discloses a plate holder having substantially the same type of base and back rest as Gibson, however, Anderson provides a different type of back rest catch mechanism which permits a larger number of base-back rest adjustments varying the lateral distance from the front part of the base to the location of the back rest.

Further, in a related patent, Dalbo in Pat. No. 4,483,505, details a foldable stand adapted to hold a card (such as Bingo) for easy viewing wherein a similar two legged base is utilized with a pivotal back rest. However, the pivotal back rest is permanently attached at the front portion of the base, rather than being attached distal from the base front portion to the legs.

While the above inventions described very ably display plates and saucers, there is a need to display both decorative cups and saucers together, or singularly, as desired. This is especially so where a person has matching sets of china.

Accordingly, it would be useful to have a display device which is universal in that it will display plates and saucers singularly, including shallow and deep dishes, or display cups singularly, or display both cups and plates or saucers simultaneously.

SUMMARY OF THE INVENTION

This invention relates to a universal cup and saucer display for prominently displaying decorative plates and saucers, and cups, either singularly or in combination.

More specifically, the invention includes a base consisting of a pair of parallel elongated legs fixedly spaced and held apart by a plurality of cross members with decorative and functional designs situated at each end of each leg. The design at the front end of each leg consist of feet on the bottom to allow the invention to rest upon a horizontal surface, and an upper rounded catch on the top part, the rounded catch adapted to receive the circular rim of the plate or saucer when the invention is utilized to display a single plate or saucer.

At the rear end of each leg is another functional design having legs also on the bottom (the back and front legs adapted to permit the invention to rest upon a horizontal surface) and an upper rounded portion adapted to receive and secure a pin which pivotally connects with the back rest. This provides a point about which the back rest may rotate so as to provide a support for the plate which may be adjusted to most prominently display the plate or saucer.

The back rest of the invention comprises a flat surface with outstanding wings situated along three of its four sides (two at right angles), the flat surface stretching between the two legs and protruding outward from its position pivotally connected at the rear upper rounded portions of the legs. The top edge portion of the flat surface making up the back rest defines a concave arcuate edge in order that the underside bottom surface of the displayed plate or saucer is contacted at two points to insure stability, and, for decorative reasons, a heart is cut into the back surface. In the center of the back surface near the top concave edge is located an opening for hanging the subject invention on a nail protruding from a wall. By such means, the inventive universal cup and saucer display may prominently display decorative cups and saucers from a wall location, rather than resting upon a horizontal surface.

Pin means to permit the back rest to pivot have preferably utilized a machine screw and nut, the head of the machine screw covering the opening in the upper rounded portion of the ornamental design at the rear design part of the legs with the threaded shank of the machine screw protruding through the opening in the upper rounded portion of the leg design and continuing through an opening in the wing portion of the back rest. A nut is screwed onto the threads of the machine bolt and by varying the tightness of the nut, the frictional relationship between the inside portion of the leg upper rounded portion and the wing portion of the back rest may be adjusted so that, if desired, the back, once rotated to a desirable position, will tend to stay in place and thus hold the plate or saucer properly upright.

Obviously, when the inventive universal cup and saucer display is used by placement upon a nail protruding from a wall, the base will extend from the wall at a right angle (assuming the back rest is at a right angle to the base). To maintain that right angle relationship when a plate or saucer and/or cup is displayed, sufficient tightening of the nut on the machine screw to hold the base at a right angle to the back rest is required, since the back rest remains against the wall.

Lastly, a removable cup insert plate is positioned between the two parallel legs, the cup insert plate also being parallel in its elongated direction to the plurality of cross members. A step is formed in the inside top edge of opposite sides of the elongated legs in order to receive the ends or the cup insert plate and to secure the plate there against horizontal movement and downward movement. Of course, the plate may be removed in the vertical direction when desired or when a cup is not to be displayed. The cup insert plate is characterized by centrally located opening, the opening adapted to receive the side walls of the cup held for display. In an alternate embodiment, the opening through the cup insert plate is modified so that it is no longer an opening, but is a hollowed out rounded disk cavity which receives the base of the cup to provide a support for the cup.

It is an object of the subject invention to provide a display device for displaying decorative cups and saucers simultaneously in a prominent position.

It is another object of the subject invention to provide an attractive display to prominently display a plate or saucer, or, a decorative basket in a prominent position.

It is still another obJect of the subject invention to provide an attractive device to display a decorative cup in a prominent position.

Other objects of the invention will in part be obvious and will in part appear hereinafter. The invention accordingly comprises the apparatus comprising the construction, combination of elements, and arrangement of parts which are exemplified in the following detailed disclosure and the scope of the invention which will be indicated in the Claims.

BRIEF DESCRIPTION OF THE DRAWINGS

For further understanding of the nature and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
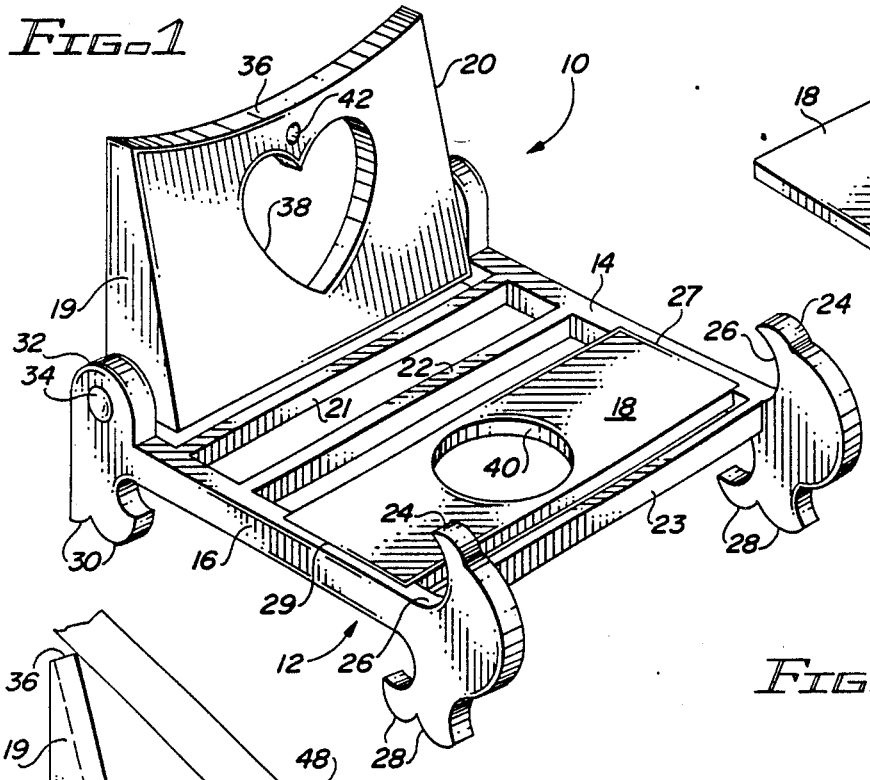
FIG. 1 is a perspective view of the subject invention.

Referring now to FIG. 1, a perspective view of the inventive universal cup and saucer display 10 is shown. The display comprises three primary elements, firstly base 12 having elongated legs 14 and 16, removable cup insert plate 18, and pivotal back rest 20.

Base 12 is constructed of a number of pieces, legs 14 and 16 as previously mentioned, and three cross members, namely rear cross member 21, middle cross member 22, and front cross member 23, all cross members joining at their opposite ends to legs 14 and 16. Cross members 21, 22, and 23 are fixedly attached between legs 14 and 16 by an adhesive or, alternatively, base 12 may be formed of one piece of molded plastic or other materials, such as wood or metal. In any event, cross members 21, 22, and 23 consisting of thin plastic, wood or metal member struts provide stability to legs 14 and 16 as well as resist motion of one leg relative to the other such as would form a collapsing parallelogram. In addition, rear and middle cross members 21 and 22 respectively assist by receiving the circular rim of the plate or saucer to be displayed in the space between them. Legs 14 and 16 are mirror images of each other and would be complete duplicates of each other if it were not for step 27 and 29 formed in the top inside edge of the elongated portion of legs 14 and 16 respectively, such step shown more clearly in FIGS. 3 and 5. The steps adapt to receive cup insert plate 18 which itself is further discussed hereafter.

Legs 14 and 16 comprise an elongated member having identical attractive functional designs at each of their respective ends, the front end design having a uprising decorative upper portion 24 which provides a rounded catch 26 immediately adjacent the top of the elongated portion of each leg, the rounded catch 26 providing means to receive the circular rim of a plate or basket when it is desired that the subject universal cup and plate display be utilized to display only a plate or basket without an associated cup. On the bottom portion of the eye pleasing design at the front end of legs 14 and 16 are front feet 28, feet 28 adapted to reside on a shelf or other flat horizontal surface. The attractive design at the front portion of each leg thus functions with rounded catch 26 and feet 28 features.

At the rear portion of legs 14 and 16 is another attractive and functional design which includes the rear feet 30 on the bottom and upper rounded portion 32 on the top. Rear feet 30 accomplish the same purpose as do front feet 28, namely to support the universal cup and saucer display when placed upon a flat horizontal surface. Upper rounded portion 32 provides a means to secure pivot pin 34 which permits, by penetrating openings formed in upper rounded portion 32 and wing 19 of back rest 20, to render back rest 20 pivotal. Not shown in FIG. 1 by virtue of its being hidden by pivotal back rest 20 is the rear decorative and functional design of leg 14 which is identical to that described for leg 16.

In the universal cup and saucer display 10 shown in FIG. 1, cup insert plate 18 is shown with centrally located opening 40 situated therein. Opening 40 is adapted to receive the lower side wall portions of a cup to hold the cup in place when a cup, or a cup and plate, are displayed. When a plate is displayed with a cup, the plate is placed into the universal cup and plate display 10 in a somewhat vertical orientation where the bottom underside portion of the plate is placed against pivotal back rest 20 and then the rounded rim of the plate is received into the space between the rear cross members 21 and middle cross member 22. Of course, it would be possible to place the rim of the plate between the bottom edge of back rest 20 and rear cross member 21, or between middle cross member 22 and the edge of cup insert plate 18 if desired, or if necessary because the plate has a relatively deep bottom. Pivotal back rest 20, which operates in a tight frictional relationship with upper rounded portion 32 of legs 14 and 16, is pivoted to the position to support the upright plate in the best viewing manner. It is additionally possible to display shallow soup bowls in the subject invention whereby the rounded upper rim of the soup bowl would be received in that space between the middle cross member 22 and the rear edge of cup insert plate 18.

Figure 2:
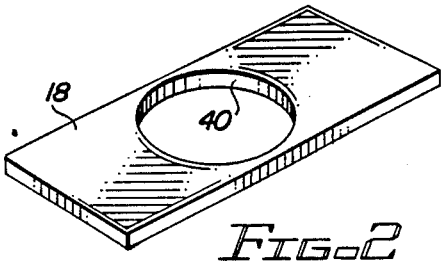
FIG. 2 is a perspective view of the removable cup insert plate.
Figure 6:
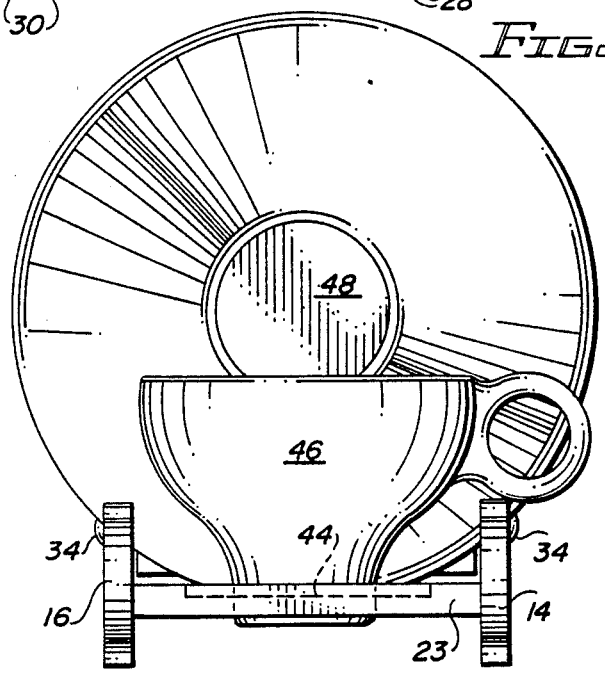
FIG. 6 is a front view of the subject invention in use prominently displaying a cup and saucer.

Referring now to FIG. 2, a perspective view of removable cup insert plate 18 is detailed showing it to be a flat, relatively thin, elongated plate having square corners and edges with a centrally located opening 40, opening 40 taking up ¾ or so of the width of plate 18. Opening 40 is adapted to receive the lower portion of the side walls of a cup. In FIG. 2, opening 40 is shown penetrating fully through plate 18, however, it is of course realized that the opening need not fully penetrate plate 18, but alternately, a disk shaped hollowed out portion may be formed totally within plate 18 so that the base of a cup would then rest totally upon the hollowed out disk shaped portion. Such an alternate embodiment is shown in FIG. 6 where the invention is displayed with a cup and saucer together.

Figure 3:
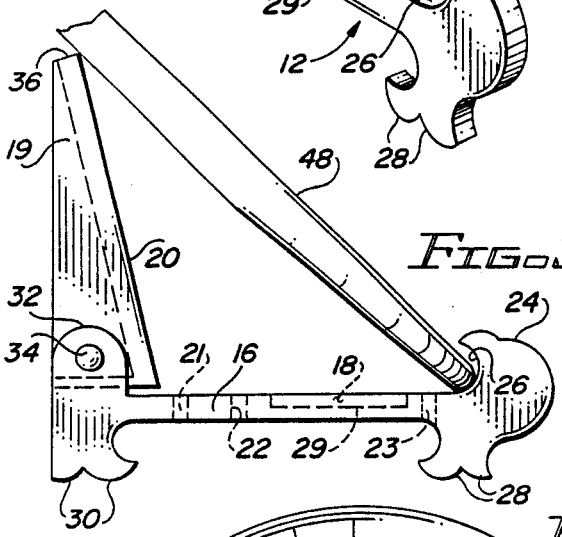
FIG. 3 is a side view of the subject invention.

Referring now to FIG. 3, a side view of the subject universal cup and saucer display 10 is shown with a plate singularly displayed. Starting from the front, the attractive functional design situated at the front portion of leg 16 is shown firstly with uprising portion 24 which forms rounded catch 26 designed to receive the circular rim of a basket or deep bowl (or plate singularly displayed as shown), and front feet 28. Following the front decorative design portion of leg 16 is the leg elongated member portion, the elongated member portion having connected to it the front, middle, and rear cross members 23, 22, and 21 respectively (shown here by dotted lines), which secures leg 16 to leg 14 (not shown). Seen also in dotted form is the end of cup insert plate 18 which resides in step 29 of leg 16. For smoothness in design, the upper edge of step 29 also coincides with the top surface of cup plate 18.

To the rear of leg 16 is the attractive functional design containing rear foot 30 adapted, as with front foot 28, to rest upon a flat horizontal surface. At the top portion of the rear design is raised up upper rounded tab portion 32 situated to receive pivot pin 34 which permits pivoting or rotation or back rest 20 to its most suitable position.

Back rest 20 shown in FIG. 3 is somewhat triangular when viewed from the side. It comprises the flat back surface prominently displayed in FIG. 1 and a thin, flat side wing 19 formed at a 90-degree angle to the flat front facing surface. In addition, the bottom portion of back 20 contains a thin flat bottom wing member which connects both the front facing portion of back 20 to both side wings in order to strengthen the attachment of the side wings to the front portion. It is through side wing 19 that an opening is placed to receive pivot pin 34. Nominally, pivot pin 34 comprises a short machine bolt (whose head is visible in FIG. 3) and a securing nut at the opposite end of the bolt. The securing nut then is inside the shallow dish formed by the front surface of back 20 and the connecting side wings on the three sides.

Back rest 20 shown in FIG. 3 is pivotable throughout a substantial portion of a circle. Firstly, back rest 20 will pivot forward to the point where the front surface of back 20 strikes cross member 21 which, at that point, back 20 is almost lying totally parallel to legs 14 and 16 and upon all three cross members. Further, back rest 20 will rotate to the rear as far as needed, almost to complete a circle. It may be desirable to place stops upon the possible backward rotation of back rest 20 as deemed necessary. Such stops may be constructed very easily by placing appropriately located protruding tabs on the inside portion of the design at the rear of both legs such that the side wings of back rest 20 will strike the protruding tab and terminate rotation. Although termination of rotation by back rest 20 may also be accomplished by the above method, since it is anticipated that back 20 will be in a tight pivotal relationship with the upper rounded portion of legs 14 and 16, suitable tightening of machine bolt 34 may obviate the need for stopping tabs. Obviously, by rotating back rest 20 forward, less storage space of the product is required and packaging is enhanced.

By Way of illustration of singularly displaying a plate, plate 48 has been put in place to show how it may be displayed independently of a cup. The circular rim of the plate is shown engaging rounded catch 26 and back rest 20 engages the bottom surface of plate 48.

Figure 4:
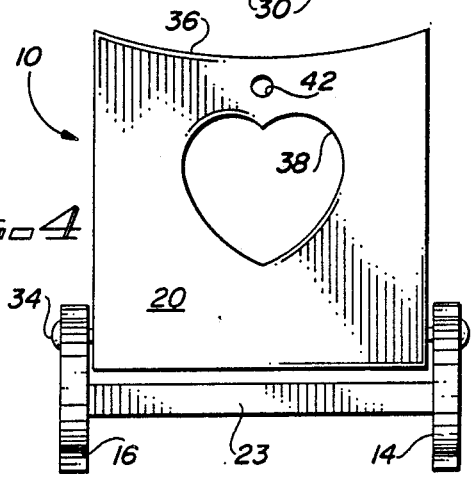
FIG. 4 is a front view of the subject invention.

Referring now to FIG. 4, a front view of the universal cup and saucer display is detailed showing firstly, the front design portions of legs 14 and 16, as well as front cross member 23. Then, to the rear of cross member 23 is back rest 20 with its arcuate shaped top edge 36 illustrated from side to side, the centrally located heart shaped opening 38 for decorative purposes, and round opening 42 at the upper portion of back rest 20. The purpose of opening 42 is to allow the subject universal cup and saucer display to be hung on a wall by means of a nail driven into the wall, whereupon the nail would then reside interiorly to opening 42. Thus, the inventive universal cup and saucer display may also be mounted upon a wall in addition to being placed upon a flat horizontal surface. By suitable tensioning of the pivotal means, pin or bolt 34, the pivotable relationship between back rest 20 and legs 14 and 16 can be substantially held at one angle sufficiently well to support the cup and saucer displayed with the leg portions protruding outward from the wall, preferably at a perpendicular angle to the wall.

Figure 5:
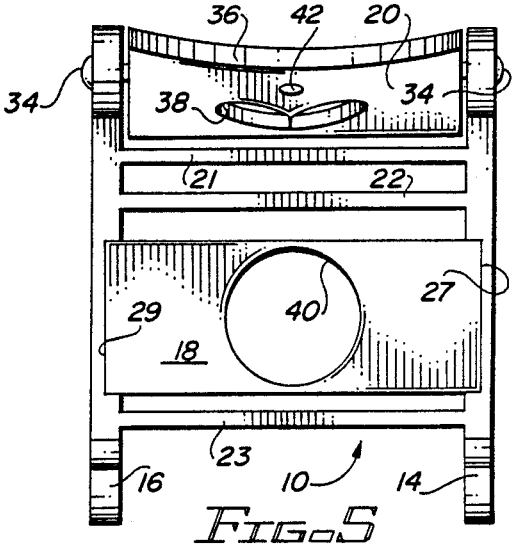
FIG. 5 is a top view of the subject invention.

Next, a top view of the subject universal cup and saucer display is shown in FIG. 5. Starting from the lower part of the figure and working upward, the ends of legs 14 and 16 are shown at the lowermost part with cross member 23 attached between the two legs immediately above the end area. With a thin space immediately above cross member 23, cup insert plate 18 is shown with its central opening 40 adapted to receive an associated cup. As earlier mentioned, step 27 in leg 14 and step 29 in leg 16 adapted to receive cup insert plate 18 are shown, each of these steps coinciding with the ends of cup insert plate 18 (the lower surface edge of step 29 shown by dotted line in FIG. 3). Step 29 is a right angle indentation or cut taken in the upper inside edge of the elongated front portion of each leg.

Continuing upward, middle cross member 22 is seen immediately above the space between the top elongated edge of cup insert plate 18, with middle cross member 22 then followed by rear cross member 21. Lastly, back rest 20 is seen with the lower most edge of the front facing surface closest to rear cross member 21. Next, the decorative heart 38 is shown central to back rest 20 with opening 42 immediately above. Lastly, arcuate shaped top edge 36 is seen at the very upper portion of back 20.

FIG. 6 shows a front view of the universal cup and saucer display with a cup and saucer in place. Like the front view shown in FIG. 4, legs 14 and 16 are at the lower most portion of the figure with front cross member 23 prominent. Shown immediately above front cross member 23 is cup 46, cup 46 having its base resting within the disk shaped hollowed out portion 44 (shown dotted) of cup insert plate 18 residing immediately behind front cross member 23. This is the alternate embodiment for cup insert plate 23 spoke of in connection with FIG. 2. If the preferred embodiment were utilized, cup 46 would have its base extending through opening 40 detailed in FIGS. 1 and 2 and dotted lines show cup 46 extending below front cross member 23 and below cup insert plate 18 (hidden behind cross member 23). Lastly, plate or saucer 48 is shown immediately behind cup 46, saucer 48 having a diameter larger than the width of the invention between opposite legs such that both cup 46 and saucer 48 dominate the universal cup and saucer display. Saucer 48, as earlier described in connection with FIG. 3, has a portion of its circular rim protruding between the middle and rear cross members as shown by the outline of the rim below cross member 23.

Figure 7:
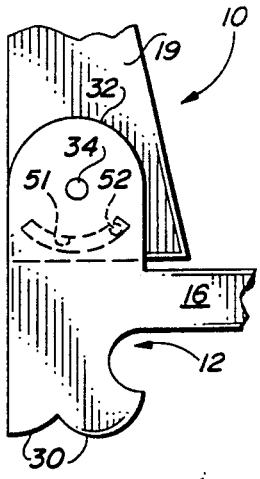
FIG. 7 is a partial side view of the subject invention showing means to limit rotation of the pivotal back rest.

While in description of FIG. 3, suggestions were made of various methods terminating rotation of pivotal back rest 20 at suggested limits, FIG. 7 illustrates still another method to limit rotation of the pivotal back rest. In FIG. 7, rear design upper rounded portion 32 is shown with wing 19 of the pivotal back rest immediately behind it. Elongated leg 18 with its foot 30 is also shown. Immediately below pivotal pin 34 is shown in dotted form arcuate shaped groove 51 which is formed in upper rounded portion 32. Within this arcuate shaped groove resides boss 52 which protrudes perpendicularly from the side of wing 19. As is seen from FIG. 7, arcuate shaped groove 51 is terminated at each end which provides stops for boss 52. In the position shown the pivotal back rest may be rotated forward allowing boss 52 then to move from the right to the left within groove 51 until boss 52 intersects the end of groove 51. Thus termination of rotation of the pivotal back rest at selected positions may be accomplished through the means shown in FIG. 7. It is realized of course that the groove and the boss may be interchanged with respect to upper rounded portion 32 and wing 19, and the groove and boss arrangement may be placed upon one or both of the upper rounded portions of each leg.

While a drawing has not been shown utilizing the invention to hold a basket or rather deep bowl, it is readily apparent by viewing FIGS. 1 and 3 that such a basket or deep bowl may be secured and held by the universal cup and saucer display utilizing the back rest 20 to support the underside bottom surface of the bowl or basket and rounded catch 26 to receive the circular rim of the basket or deep bowl. Obviously, when a bowl or basket is utilized, a cup may not be displayed simultaneously. Also, if desired, when a cup is not being displayed, cup insert plate 18 may be removed from its position in steps 27 and 29 of legs 14 and 16 respectively. Or, if desired, cup insert plate 18 may remain in place between the two legs if it does not interfere with the holding of a basket or deep bowl. Whether to remove cup insert plate 18 or not is best determined by placing the basket or deep bowl in place and then seeing whether the rounded sides of the basket or bowl are interfered with by cup insert plate 18.

Further, it is obvious that a plate or saucer may be displayed singularly by placement of its circular rim either between middle and rear cross members 21 and 22, or by placement of the circular rim into rounded catch 26 of legs 14 and 16 (as shown in FIG. 3). Of course, rotation of back rest 20 to the position to support the bottom outside portion of the plate or saucer most effectively is accordingly also done.

While a preferred embodiment has been shown and described, together with an alternate embodiment, it will be understood that there is no intent to limit the invention by such disclosure, but rather it is intended to cover all modifications and alternate constructions falling within the spirit and the scope of the invention as defined in the appended Claims.

I claim:

1. A universal cup and saucer display for holding a cup and saucer each singularly, and together, in a prominent display position comprising:

a pair of spaced apart parallel elongated legs;

a plurality of cross members operably attached between said spaced apart elongated legs;

a pivotal back rest operably connected to said pair of spaced apart elongated legs, said back rest adapted to support the saucer in a prominent display position; and a removable cup insert plate situated between said pair of spaced apart legs, said cup insert plate defining a thin flat plate having an opening therethrough adapted to support a cup in said opening for prominent display whereby the cup and saucer may be simultaneously displayed, or the cup insert plate may be removed to display a saucer separately.

2. The universal cup and saucer display as defined in claim 1 wherein said spaced apart elongated legs includes steps formed in said elongated legs, said cup insert plate removably residing within said steps.

3. The universal cup and saucer display as defined in claim 2 wherein said pair of spaced apart parallel elongated legs define legs having a front end and a rear end with designs at each end, each said design including at least a foot whereby the universal cup and saucer display rests upon the feet of said designs at each end of said legs..

4. The universal cup and saucer display as defined in claim 3 wherein each of said pair of legs front design have an upper rounded catch, said catch adapted, together with said pivotal back rest, to receive the saucer when singularly displayed.

5. The universal cup and saucer display as defined in claim 4 wherein each of said pair of legs rear design includes an upper rounded portion, said raised up rounded portion adapted to be operably connected to said pivotal back rest.

6. The universal cup and saucer display as defined in claim 5 wherein said pivotal back rest includes a thin flat member having four sides, said member having attached right angle wings on three of its four sides.

7. The universal cup and saucer display as defined in claim 6 wherein two of three said right angle wings attached to said back rest are pivotably connected with said rear design upper rounded portion of said pair of elongated legs to provide means to permit said back rest to pivot.

8. The universal cup and saucer display as defined in claim 7 further including an arcuate shaped groove formed in one of said legs rear design upper rounded portion, said arcuate shaped groove having two ends, and a protruding boss formed on one of said pivotal back rest right angle wings, said protruding boss adapted to reside within said arcuate groove whereby rotation of the pivotal back rest is limited when said protruding boss strikes the end of said arcuate shaped groove.

9. The universal cup and saucer display as defined in claim 8 wherein both of said legs of said pair of legs rear design upper rounded portion further includes an arcuate shaped groove having ends thereto, and two of said right angle wings attached to said pivotal back rest include protruding bosses.

10. The universal cup and saucer display as defined in claim 7 wherein said pivotal back rest includes an opening therethrough, said opening adapted to receive an associated nail protruding from a wall to permit said universal cup and saucer display to be hung on a wall with said pair of parallel elongated legs protruding outward from said wall.

11. The universal cup and saucer display as defined in claim 10 further including a pivot pin attaching said upper rounded portion of said leg to said back rest right angle wings, said pivot pin including nut means to tighten said pivotal relationship between said raised up rounded portion and said back rest right angle wings whereby said pivotal back rest may be adjusted to a position and remain there.

12. A universal cup and saucer display for holding a cup and saucer each singularly, and together, in a prominent display position comprising:

a pair of spaced apart parallel elongated legs;

a plurality of cross members operably attached between said spaced apart elongated legs;

a pivotal back rest operably connected to said pair of spaced apart elongated legs, said back rest adapted to support the saucer in a prominent display position; and a removable cup insert plate situated between said pair of spaced apart legs, said cup insert plate defining a thin flat plate having a hollowed out disk shaped indentation therein adapted to support a cup in said indentation for prominent display whereby the cup and saucer may be simultaneously displayed, or the cup insert plate may be removed to display a saucer separately.

* * * * *